United States Patent [19]

Peilet

[11] 4,143,667

[45] Mar. 13, 1979

[54] RETRACTABLE DISPENSING BRUSHES

[76] Inventor: Lester R. Peilet, 6144 N. Talman Ave., Chicago, Ill. 60659

[21] Appl. No.: 747,535

[22] Filed: Dec. 6, 1976

Related U.S. Application Data

[62] Division of Ser. No. 579,441, May 21, 1975, Pat. No. 4,001,910.

[51] Int. Cl.[2] ..... A46B 11/02

[52] U.S. Cl. ..... 401/28; 401/99; 401/183; 132/116

[58] Field of Search ..... 410/99, 28, 185, 183, 410/184, 286, 290, 282; 15/104.5, 257.05, 184; 132/116

[56] References Cited

U.S. PATENT DOCUMENTS

| | | | |
|---|---|---|---|
| 954,133 | 4/1910 | Reed | 401/286 X |
| 1,062,053 | 5/1913 | Strong | 401/28 X |
| 2,865,039 | 12/1958 | Kame et al. | 15/184 |
| 3,053,264 | 9/1962 | Breton | 401/28 X |
| 3,146,484 | 9/1964 | Lussier et al. | 401/28 X |
| 3,263,265 | 8/1966 | Judson | 401/208 X |
| 3,357,395 | 12/1967 | Lorber | 401/183 X |

*Primary Examiner*—Stephen C. Pellegrino

*Attorney, Agent, or Firm*—Burmeister, York, Palmatier, Hamby & Jones

[57] ABSTRACT

Retractable brushes are disclosed having provision for dispensing any suitable liquid or other material which is to be used in connection with the brush. The material to be dispensed is held in a container which is mounted on the rear side of the brush. A disengageable coupling is provided between the container and a passage extending through an axial member to the front of the brush. The container may take the form of a squeeze bottle or may otherwise be compressible.

7 Claims, 16 Drawing Figures

FIG. 9
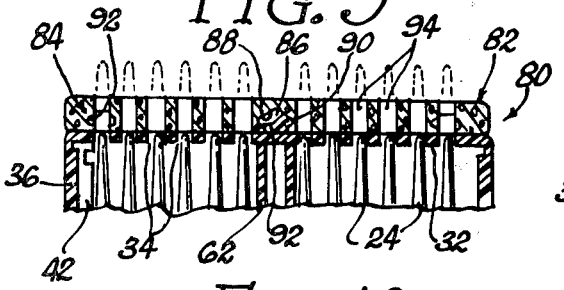
FIG. 11
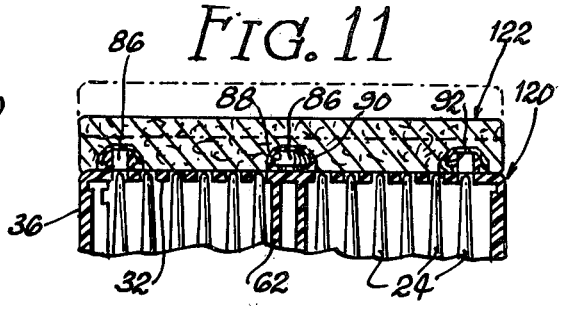
FIG. 10
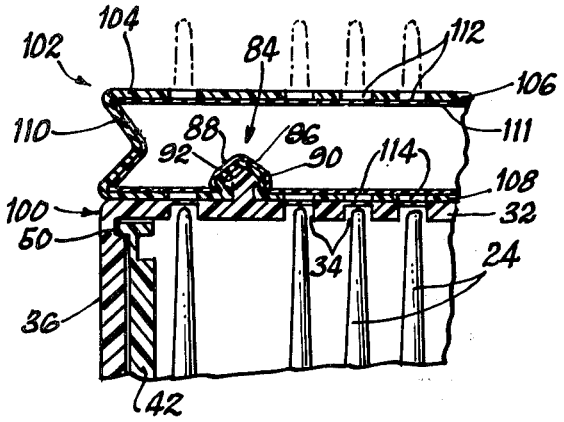
FIG. 12
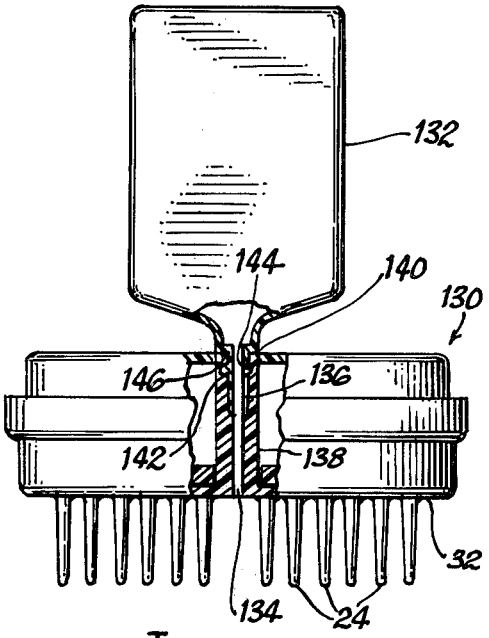
FIG. 13
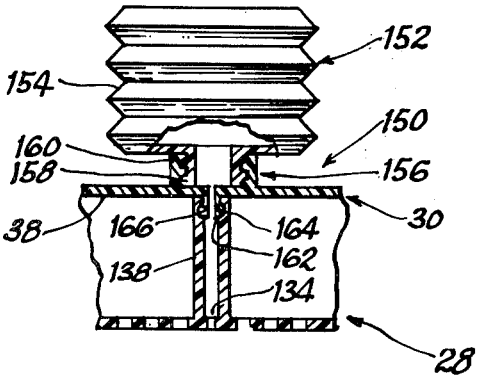
FIG. 14
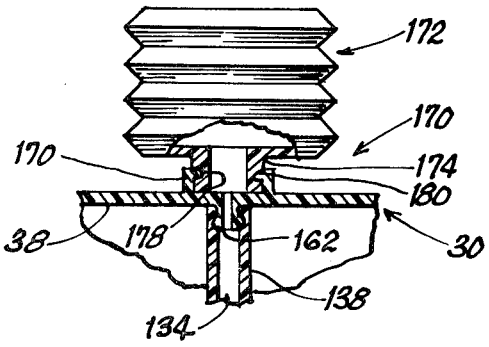
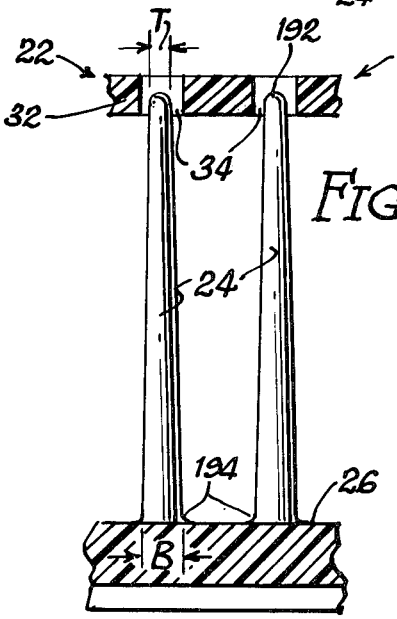
FIG. 15

RETRACTABLE DISPENSING BRUSHES

This application is a division of my copending application Ser. No. 579,441, filed May 21, 1975, now U.S. Pat. No. 4,001,910, issued Jan. 11, 1977.

This invention relates to retractable brushes, of the general type having bristles which can be retracted into the casing of the brush, or moved outwardly from the casing into the position at which the bristles are used.

One object of the present invention is to provide retractable brushes having provision for dispensing a liquid or some other material which is to be used in connection with the brush. Such material may take the form of a shampoo, soap, detergent, any other suitable cleaning compound, a coloring compound, hair conditioner, or any other suitable substance.

A further object is to provide a dispensing brush in which the liquid or other material to be dispensed is held in a container which is mounted on the rear side of the brush. A passage may be provided from the container to the front side of the brush, to carry the material to be dispensed. The container may be compressible and thus may be in the form of a squeeze bottle or a bellows container. A disengageable coupling may be provided between the container and an axial passage which is formed in a member extending axially through the brush.

Further objects, advantages and features of the present invention will appear from the following description, taken with the accompanying drawings, in which.

Figure 1:
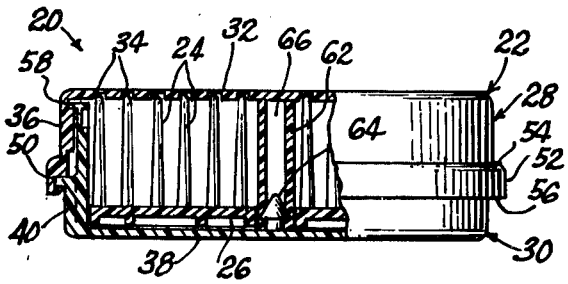
FIG. 1 is a side elevational view, partly in a central axial section, showing an illustrative retractable brush, the brush being shown in its retracted position.
Figure 8A:
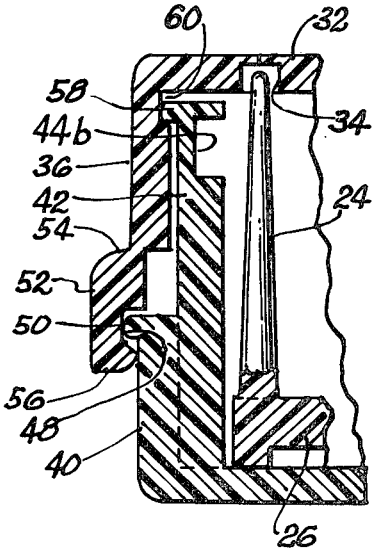
FIG. 8 is a fragmentary enlarged section taken generally along the line 8—8 in FIG. 7.

FIG. 8*a* is a fragmentary enlarged sectional view corresponding to a portion of FIG. 1, FIG. 9 is a fragmentary sectional view, somewhat similar to FIG. 1, but showing a modified brush having a dispensing member mounted on the front side of the brush.

FIG. 10 is a fragmentary enlarged sectional view, similar to a portion of FIG. 9, but showing a modified dispensing member in the form of a bellows container.

FIG. 11 is a fragmentary sectional view, similar to FIG. 9, but showing a modified dispensing member.

FIG. 12 is a side elevational view of a modified dispensing brush with a dispensing container mounted on the rear side of the brush, the view being partly in section to show the manner in which the material to be dispensed is carried from the container to the front of the brush.

FIG. 13 is a fragmentary sectional view, somewhat similar to FIG. 12, but showing a modified dispensing container.

FIG. 14 is a view somewhat similar to FIG. 13, but showing a modified connection between the dispensing container and the brush.

FIG. 15 is a fragmentary enlarged sectional view showing a modified construction.

Figure 2:
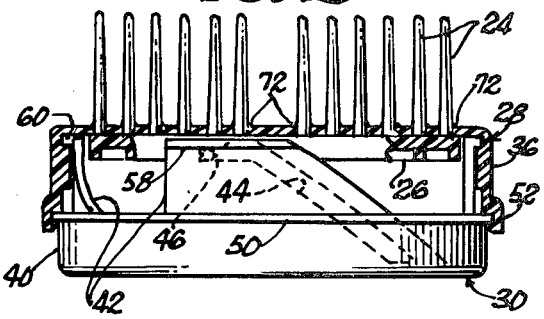
FIG. 2 is a view somewhat similar to FIG. 1, but showing the brush in its extended position, the top or front member of the brush being shown in section, while the lower or rear member is shown in elevation.

As just indicated, FIGS. 1–8 illustrate an illustrative retractable brush 20, comprising a body or casing 22, into which bristles 24 are retractable, as shown in FIG. 1. The bristles 24 are adapted to be extended out of the casing 22, as shown in FIG. 2. It will be seen that the bristles 24 are carried by a bristle member 26 which is movable within the casing 22.

Bristles of any suitable type may be employed. Thus, the bristles may be of the tufted type, arranged in tufts, each containing a multiplicity of bristles, mounted on the bristle member. However, in this case, the bristles 24 are of the individual or single type, which may be molded in one piece with the bristle member 26, from a suitable flexible material, such as a polyethylene or polypropylene plastic material, for example.

The illustrated casing 22 comprises front and rear members 28 and 30. In this case, the front member 28 comprises a front wall 32 having openings 34 therein, through which the bristles 24 are adapted to be extended and retracted. The illustrated front member 28 also has an annular side wall 36 extending rearwardly from the front wall 32. The side wall 36 may be generally cylindrical in shape. The front member 28 may be molded from a suitable plastic material, such as polyethylene or polypropylene, for example.

In this case, the rear member 30 comprises a rear wall 38 and an annular side wall 40 projecting forwardly therefrom, the side wall 40 being generally cylindrical in shape. The rear member 30 may also be molded from a suitable plastic material, as in the case of the front member 28.

Various means may be employed to provide for the extension and retraction of the bristles 24. In this case, the movement of the bristles 24 is brought about by relative rotation between the front and rear members 28 and 30 of the casing 22. Thus, the front member 28 may be held in one hand, while the rear member 30 is rotated to produce the extension and retraction of the bristles 24. Rotation of the rear member 30 in one direction produces extension of the bristles 24. Retraction of the bristles is produced by rotation of the rear member 30 in the opposite direction. The front and rear members 28 and 30 are held together for relative rotation in a manner to be described presently.

In the illustrated brush construction, the reception of the bristles 24 in the openings 34 prevents any relative rotation between the bristle members 26 and the front casing member 28. The rear casing member 30 includes means for converting the rotation of the rear member 30 into forward and rearward movement of the bristle member 26. Such conversion may be brought about by various means, such as the illustrated cam members 42 projecting forwardly on the side wall 40 of the rear member 30. The illustrated brush 20 comprises three such cam members 42, each formed with a cam track or groove 44, as shown most clearly in FIGS. 2 and 4. The bristle member 26 preferably comprises tabs or followers 46 which engage and follow the cam tracks 44. The illustrated followers project outwardly from the bristle member 26, which is generally circular in shape. Each of the illustrated cam tracks 44 has an inclined portion 44*a* and a level front portion 44*b* which retains the bristle member 26 in its extended position. The cam members 42 are preferably molded in one piece with the rear casing member 30.

When the rear casing member 30 is rotated in one direction, relative to the front casing member 28, to extend the bristles, the tabs or followers 46 are pushed forwardly by the cam tracks 44, until the tabs 46 enter the level front portions 44*b* of the tracks. The rotation of the rear casing member 30 may be limited by the engagement of the tabs with the extreme ends of the level track portions 44*b*.

Figure 3:
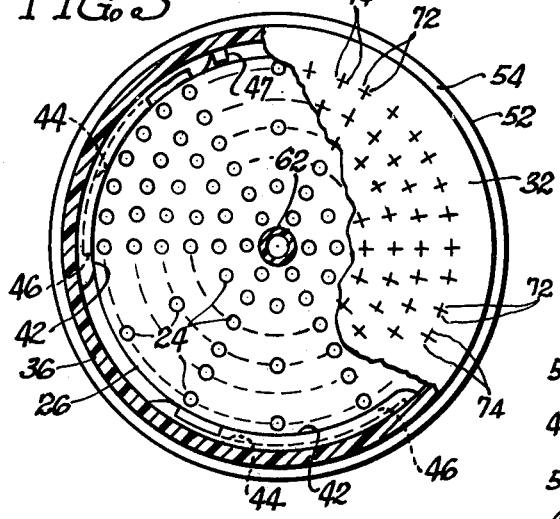
FIG. 3 is a front or top view of the brush, with a portion broken away and shown in section.

When the rear casing member 30 is rotated in the opposite direction, the cam tracks 44 push the tabs or followers 46 rearwardly. The rotation may be limited by providing a stop 47, projecting inwardly from the front casing member 28, for engagement with one of the cam members 42, as shown in FIG. 3.

Means are provided to hold the front and rear casing members 28 and 30 together, while providing for relative rotation of the members. Such means are arranged so that the front and rear members 28 and 30 can be assembled by pushing them together, without the use of any extra fasteners.

Figure 4:
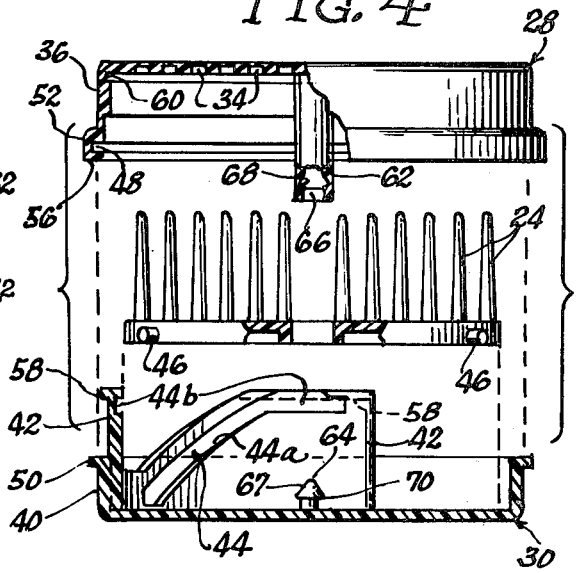
FIG. 4 is an exploded or disassembled elevational view with portions shown in section.

As shown most clearly in FIG. 4, the annular side walls 36 and 40 of the front and rear members 28 and 30 are preferably formed with annular detent elements, which may take the form of a lip on one of the members and a groove in the other member. In the illustrated construction, the side wall 36 of the front member 28 is formed with an internal annular groove 48, adapted to receive an annular outwardly projecting lip or ridge 50 on the side wall 40 of the rear member 30. The casing members 28 and 30 are sufficiently flexible and resilient to allow the lip 50 to be snapped into the groove 48 by pushing the members 28 and 30 together.

The detent groove 48 is preferably formed within an enlarged rear portion 52 of the side wall 36. The enlarged portion 52 provides circumferential shoulders 54 and 56 facing in opposite directions. Such shoulders are useful in packaging the brush 20 on a display card or the like, in that the shoulders will retain the brush in circular holes formed in the panels of a folded display card. The panels can then be stapled or otherwise fastened together to retain the brush on the card.

It has been found to be desirable to provide additional retention between the front and rear casing members 28 and 30, because it is relatively easy to disengage the lip 50 from the groove 48, by gripping the enlarged portion 52 and then compressing it into a slightly oval shape. To provide such additional retention, it is preferred to provide additional push-together detent elements on the front and rear members 28 and 30. As shown most clearly in FIG. 4, an additional detent element 58 is preferably provided on each of the cam members 42 and is adapted to mate with a detent element 60 on the front casing member 28. As shown, the detent elements 58 on the cams 42 are preferably in the form of lips or ridges, while the detent element 60 is in the form of a mating internal annular groove, within the side wall 36 of the front casing member 28. In the illustrated construction, there are three of the cam members 42, each of which is formed with one of the lip detent elements 58.

Further retention between the front and rear casing members 28 and 30 is preferably afforded by axial push-together detent elements, illustrated as being formed on telescoping axial posts or shafts 62 and 64 on the front and rear casing members 28 and 30. In this case, the post 62 is hollow or tubular, and thus is formed with an axial oepning 66, adapted to receive the post 64. It will be seen that the post 64 has a tapered end portion 67 to facilitate the entry of the post 64 into the opening 66. Annular detent elements 68 and 70 are preferably provided on the posts 62 and 64. As shown, the detent element 68 is in the form of an annular groove, located within the opening 66. The detent element 70 takes the form of a lip or ridge, adapted to snap into the groove 68 when the posts 62 and 64 are pushed together. It will be understood that the posts 62 and 64 are sufficiently elastic to permit the detent elements 68 and 70 to be assembled by pushing the posts together.

As shown to best advantage in FIGS. 5–8, the brush 20 is preferably provided with means for wiping the bristles 24 as they are extended and retracted. The wiping action is valuable, because it effectively cleans the bristles. When the brush is used as a hair brush, the wiping action very effectively removes any loose hair from the bristles.

As shown in FIGS. 5–8, the bristles 24 are arranged to be wiped by a plurality of flexible flaps 72, at least partially closing the bristle openings 34 when the bristles are retracted. The flaps 72 extend at least partially across the openings 34.

In the construction of FIGS. 5–8, the flaps 72 are produced by forming slits 74 in a thin membrane 76 which extends across each of the openings 34. At least one slit extends across the membrane 76. In this case, two crossed slits 74 extend across each opening 34, so that the membrane 76 is divided into four of the flaps 72.

Figure 7:
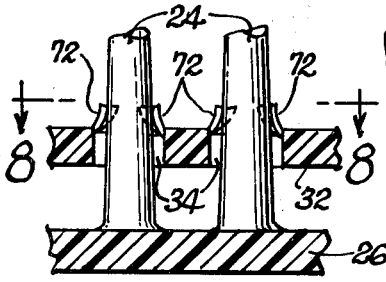
FIG. 7 is a fragmentary enlarged sectional view, corresponding to a portion of FIG. 2 and showing the bristles in their extended position.
Figure 8:
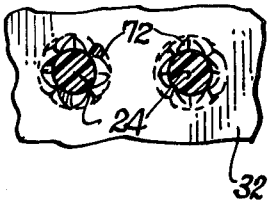

The membrane 76 may be integral with the front wall 32, or formed as a separate piece, secured or laminated to the front wall. As illustrated, the membrane 76 is molded in one piece with the front wall 32. The flaps 72 are sufficiently flexible to swing forwardly to accommodate the bristles 24, as shown in FIGS. 7 and 8.

Figure 5:
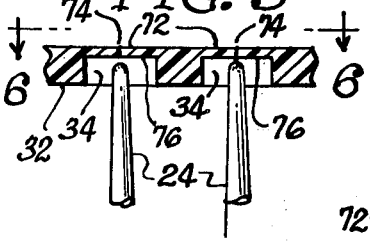
FIG. 5 is a fragmentary enlarged section corresponding to a portion of FIG. 1, showing the bristles in their retracted position.
Figure 6:
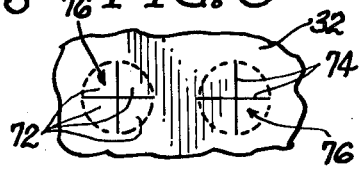
FIG. 6 is a fragmentary enlarged front view, corresponding to a portion of FIG. 3, the view being taken as indicated by the line 6—6 in FIG. 5.

When the flaps 72 are in their initial positions, as shown in FIGS. 5 and 6, the openings 34 are substantially closed and sealed by the flaps, so as to prevent the entry of any substantial amount of liquid or solid material into the casing 22 through the openings 34. When made integrally with the front wall 32, the flaps 72 are preferably made of a flexible plastic material, such as polyethylene or polypropylene, for example. When the flaps are formed from a separate piece of sheet material, laminated to the front wall 32, the flaps may be made of any suitable flexible material, such as synthetic rubber, natural rubber, or various plastics.

FIGS. 9–14 illustrate various dispensing brushes which are modifications of the retractable brush shown in FIGS. 1–8. The dispensing brushes of FIGS. 9–14 are adapted to dispense various liquid or solid materials which may be used advantageously in connection with the brush. For example, such materials may include shampoos, detergents, soaps, hair conditioners, hair coloring materials, hair bleaches, other hair care materials, powders, various cleaning components, and the like.

FIGS. 9–11 illustrate retractable brushes having dispensing members which are mounted on the front side of the brush, from which the bristles are adapted to be extended. The dispensing member may hold a liquid, paste, powder or solid material to be dispensed.

More specifically, FIG. 9 illustrates a retractable brush 80 which is similar in most respects to the retractable brush 20 of FIGS. 1–8. Insofar as the brush 80 is the same as the brush 20, the same reference characters will be employed to avoid needless repetition of the previous description. However, the brush 80 of FIG. 9 is fitted with a dispensing member 82, mounted in front of the front wall 32. The dispensing member 82 is preferably secured to the brush 80 in such a way that the dispensing member can easily be removed and replaced. In this case, a plurality of snap fasteners 84 are provided between the dispensing member 82 and the front wall 32. The illustrated snap fasteners 84 comprise detent posts 86, projecting forwardly from the front wall 32. The detent posts 86 are similar to the detent post 64 of FIGS. 1–4. It will be seen that the detent posts 86 are adapted to snap into detent openings 88 formed in the rear side of the dispensing member 82.

The detent elements 86 and 88 are formed with mating detent formations, which may assume the form of annular ridges or lips 90 on the posts 86, and annular grooves 92 formed in the openings 88.

The dispensing member 82 is secured to the brush 80 by pushing the detent elements 86 and 88 together. The dispensing member 82 can be removed quite readily from the brush 80 by pulling the detent elements 86 and 88 apart.

As shown in FIG. 9, the dispensing member 82 takes the form of a pad which is adapted to hold the material to be dispensed. Thus, the pad 82 may be impregnated with a liquid or paste material which is to be dispensed. The pad 22 may be made of any suitable material, such as a plastic or rubber sponge material, for example.

The pad 82 may also be impregnated with a powder or solid material which is to be dispensed. Any such liquid, paste or powder material may be dispensed by applying pressure to the dispensing pad 82, so that the material will be squeezed out of the pad. In the case of a solid material, the pad 82 may be moistened prior to use so that the solid material will be dissolved in the moistening liquid.

The illustrated dispensing member 82 is formed with a plurality of openings or apertures 94 through which the bristles 24 may be extended. The apertures 94 are aligned with the openings 34 in the front wall 32.

Initially, the dispensing pad 82 may be covered over its entire surface by a sealing film or layer, adapted to prevent the escape of moisture, so that the pad will remain moist if it is impregnated with a liquid or paste material. The sealing film is penetrated by the bristles 24 when they are extended, so that the material to be dispensed can escape from the dispensing pad 82 through the openings produced by the bristles. If the material to be dispensed is in a dry, solid form, water or some other moistening liquid is applied to the dispensing pad immediately before use. Sufficient liquid is employed to dissolve the material to be dispensed, or at least to fluidize it.

During the use of the brush 80, pressure is exerted upon the dispensing pad 82 by the bristles 24 and by engagement of the pad with the fingers of the user and with the hair or other material with which the brush is used. Such pressure squeezes the material from the dispensing pad 82 so that the material is applied to the hair, fabric or other material engaged by the bristles.

In some cases, the openings 94 in the dispensing pad 82 may be smaller than the bristles 24, so that the bristles will apply lateral pressure to the pad 82 as the bristles are extended. The pad 82 should be soft enough to permit the full extension of the bristles 24.

In other cases, the dispensing pad is made of a soft porous material which can readily be penetrated by the bristles 24 without the previous formation of openings in the pad. In this case, the bristles form their own openings in the pad 82. As the bristles are extended, they apply lateral pressure to the pad so that the material to be dispensed is squeezed out of the pad. Various materials can readily be penetrated by the bristles, including woven, knitted, mesh or nonwoven fabrics made of natural or synthetic fibers, batting material made of natural or synthetic fibers, and soft foam or sponge materials made of various plastics or the like.

FIG. 10 illustrates another retractable brush 100 which is similar to the brushes 20 and 80 of FIGS. 1 and 9, but is fitted with a modified dispensing member 102. To avoid needless repetition of the preceding description, the same reference characters have been applied in FIG. 10 as in FIGS. 1–9 insofar as the corresponding components are the same.

In the construction of FIG. 10, the dispensing member 102 comprises a bellows container 104 having front and rear walls 106 and 108 with a pleated annular side wall 110 extending therebetween. Because of the pleated side wall 110, the container 104 is readily compressible in the manner of a bellows. The inherent resilience of the side wall 110 causes the container 104 to expand to its initial position, as shown in FIG. 10, when the container is released.

The dispensing member 102 is removably secured to the front wall 32 of the brush 100. As shown, the dispensing member 102 is removably secured to the front wall 32 by the same push-together detent members 86 and 88 as described in connection with FIG. 9. Thus, the detent post 86 is adapted to be snapped into the detent opening 88, which is molded or otherwise formed in the rear wall 108. The detent ridge 90 is adapted to mate with the detent groove 92.

The material to be dispensed is held within the bellows container 104. Means are preferably provided to prevent the material from escaping before the dispensing member 102 is to be used. In the illustrated construction, the bellows container 104 is sealed initially by a thin liner or bag 111 made of plastic film or the like. The bristles 24 are adapted to penetrate the liner or bag 111 when the bristles are extended from the brush 100. In this way, the material to be dispensed is released, so that it is available for use in the area around the extended bristles.

In the construction of FIG. 10, the bellows container 104 is formed with openings 112 and 114 in the front and rear walls 106 and 108 thereof, for receiving the bristles 24 as they are extended. The openings 112 and 114 are closed initially by the liner.

The bellows container 104 may be made of any suitable resilient material, such as polyethylene or the like, so that the bellows container can readily be compressed.

The retractable brush 100 preferably comprises the wiping flaps 72, as previously illustrated in FIGS. 5–8, which largely prevent any leakage of the dispensable material into the casing of the retractable brush 100. The wiping flaps 72 also wipe most of the material from the bristles 24 as they are retracted into the brush 100.

FIG. 11 illustrates another retractable brush 120 which is fitted with a modified dispensing member 122. The brush 120 is otherwise similar to the brushes 20, 80 and 100. The same reference characters have been employed in FIG. 11 to identify those components which are the same as those previously described.

In the construction of FIG. 11, the dispensing member 122 may be secured to the brush 120 in the same manner as described in connection with FIG. 9. Thus, snap fastener elements 86 and 88 may be provided on the brush 120 and the dispensing member 122.

The dispensing member 122 of FIG. 11 is constructed so that it cannot be readily penetrated by the bristles 24. Thus, the dispensing member 122 may take the form of a pad or compressible container which is relatively hard, at least on its rear side, and is not formed with perforations to receive the bristles 24.

The dispensing member 122 is adapted to be used with the bristles 24 retracted. The material to be dispensed is contained in the dispensing member 122 and is adapted to be dispensed by the application of pressure to the member 122, as described in connection with FIGS. 9 and 10. Water or some other moistening liquid may also be applied to the dispensing member 122 to assist in the dispensing of the material.

As in the case of the dispensing member 82 of FIG. 9, the dispensing member 122 of FIG. 11 may be in the form of an absorbent pad or sponge, impregnated with the material to be dispensed, which may be in the form of a liquid, paste or solid material. The dispensing member 122 may also be in the form of a compressible container, as described in FIG. 10, with one or more outlet openings through which the material is dispensed.

When the dispensing member 122 has been used to the desired extent, it can readily be removed from the brush 120 by moving the bristles 24 outwardly against the dispensing member 122. The force exerted by the bristles causes the snap fastener elements 86 and 88 to be separated, so that the dispensing member 122 is released from the brush 120. The extended bristles 24 can then be used for brushing operations, in the usual manner.

FIG. 12 illustrates another modified retractable brush 130 having a dispensing container 132 which is mounted on the rear side of the brush. The interior of the container 132 connects with a passage 134 extending to the front of the brush 130. Thus, the material received within the container 132 can be dispensed through the passage 134 to the area occupied by the bristles 24 when they are extended forwardly from the brush 130. The brush 130 is otherwise generally the same as the retractable brush 20 of FIGS. 1–8. The same reference characters have been applied in FIG. 12 to those components which are the same as previously described in connection with FIGS. 1–8.

In the construction of FIG. 12, the container 132 may take the form of a squeeze bottle having a tubular outlet fitting or nozzle 136 which is telescopically related to the passage 134. As shown, the nozzle 136 is received within the rear portion of the passage 134.

As illustrated in FIG. 12, the passage 134 extends axially within an axial member or post 138. While the post 138 could be secured to the rear wall 38, it is secured to the front wall 32 in this instance. The rear portion of the post 138 is rotatable relative to an opening 140 in the rear wall 38. The post 138 is preferably molded in one piece with the front wall 32.

Means are preferably provided to secure the dispensing container 132 to the axial post 138 against accidental removal. Such means may take the form of detent elements on the container 132 and the post 138. Thus, the illustrated nozzle 136 on the container 132 is formed with an outwardly projecting detent lip or ridge 142, adapted to snap into an annular detent groove 144, formed within the passage 134 in the post 138.

The dispensing container 132 may be mounted on the brush 130 just before the brush is to be used in conjunction with the material to be dispensed. For shipment and storage, the container 132 may be closed by a cap or in any other suitable manner. The container 132 is mounted by removing the cap or other closure and inserting the nozzle 136 into the rear portion of the passage 134. Enough force is exerted on the container 132 to push the detent ridge 142 into the detent groove 144. It will be seen that the container 132 has a shoulder 146 which is engageable with the rear end of the post 138.

The dispensing container 132 does not interfere with the extension and retraction of the bristles 24, which can be extended by turning the rear housing member 30 relative to the front housing member 28. With the bristles extended or retracted, the material can be dispensed from the squeeze bottle container 132 by squeezing the container. The material to be dispensed can be in the form of a liquid, paste or powder, capable of flowing through the nozzle 136 and the passage 134.

FIG. 13 shows another retractable brush 150 which is fitted with a modified dispensing container 152 in the form of a bellows bottle. Thus, the bottle 152 has accordian pleated side walls 154.

In the construction of FIG. 13, the dispensing container 152 has a screw connection 156 to the rear wall 38 of the retractable brush 150. Such screw connection 156 is provided by screw threaded elements 158 and 160 on the container 152 and the rear wall 38. The element 158 may be in the form of an externally threaded neck on the container 152. The element 160 may be in the form of an internally threaded coupling sleeve projecting rearwardly from the rear wall 38. The element 160 may be molded in one piece with the rear wall 38.

As before, the material is dispensed through the passage 134 in the axial member or post 138. In this case, push-together coupling elements are provided between the interior of the bellows container 152 and the passage 134. Such coupling elements may take the form of a tubular member 162 projecting forwardly from the rear wall 38 and adapted to be received within the rear portion of the post 138. The tubular member 162 is formed with a detent element 164 in the form of an outwardly projecting annular ridge or lip. A mating detent groove 166 is formed within the passage 134 near the rear end of the post 138. The lip 164 is adapted to snap into the groove 166 when the tubular member 162 is pressed into the rear portion of the axial post 138. The tubular coupling member 162 is rotatable within the passage 134 in the post 138, so that the rear casing member 30 of the brush 140 can be rotated to extend and retract the bristles 24. The detent action between the lip 164 and the groove 166 is of assistance in fastening the front and rear casing members 28 and 30 together. The detent action is similar to that described in connection with the detent elements 68 and 70 of FIG. 4.

The fit between the tubular member 162 and the axial passage 134 is sufficiently close to prevent any substantial leakage of the material to be dispensed. Such material may be in the form of a liquid, paste or powder.

FIG. 14 illustrates a modified retractable brush 170 which is similar to the brush 150 of FIG. 13, except that a modified bellows container 172 is employed. The container 172 is the same as the container 152, except that push-together snap fastener elements are employed between the container 172 and the brush 170, instead of the screw thread elements of FIG. 13. Thus, the container 172 has a neck member 174 which is adapted to mate with a sleeve 176 projecting rearwardly from the rear wall 38. A shown, the sleeve 176 is formed with an inwardly projecting annular lip or ridge 178, adapted to snap into an annular groove 180, formed in the neck member 174. The connecting sleeve 176 may be molded in one piece with the rear wall 38 of the brush 170. In other respects, the construction of FIG. 14 may be the same as FIG. 13.

When the material in either of the containers 152 or 172 is to be dispensed, the bellows container 172 is mounted on the corresponding brush 150 or 170, following which the bellows container may be squeezed to force the material out of the container and through the passage 134 to the front side of the brush. The material to be dispensed can then be used in conjunction with the extended bristles 24.

In retractable brushes of the general construction illustrated in FIG. 1, it is often desirable to make the bristles 24 relatively soft and flexible, particularly when the brush is intended for use in personal grooming. The soft bristles provide greater comfort and an improved brushing action. In the past such soft bristles have been produced by making the bristles 24 and the bristle supporting member or plate 26 of an extremely soft, flexible material, such as low density polyethylene.

It is convenient and economical to mold all of the components of the retractable brush from the same plastic material. In this way, all of the components of the brush can be molded in a single mold having interconnected cavities for the various components. However, the use of a soft low density polyethylene for the casing 22 of the retractable brush tends to result in a casing which is too soft and compliant, in that the casing tends to come apart during use, due to the normal gripping force applied to the casing when it is held in the hand of the user. The normal gripping force tends to deform the casing 22 to such an extent that the front and rear members 28 and 30 become disengaged from each other.

It is possible to make the casing 22 of a relatively hard, rigid material, such as high density polyethylene, while making the bristles 24 and the bristle supporting member 26 of a soft, compliant material, such as low density polyethylene, but this method of manufacture tends to increase the cost of the retractable brushes, because the casing 22 and the bristles 24 must be molded in two different molding operations, using separate molds.

It has been found that the desired soft bristles can be achieved by using a material of medium hardness, while forming the bristles 24 with more slender dimensions, so that the diameter of the bristles is reduced. The medium hard material may comprise a mixture of approximately equal parts of high and low density materials, such as high and low density polyethylene. The medium hard plastic material may then be used in the molding of the casing 22 as well as the bristles 24 and the bristle supporting member 26. With the use of the medium hard material, the casing 22 is sufficiently hard and stiff to resist deformation when the casing is gripped by the user during normal use, so that the relatively rotatable front and rear members 28 and 30 of the casing will not come apart accidentally.

FIG. 15 is a fragmentary enlarged sectional view showing the relatively slender dimensions of the bristles 24, so as to produce bristles having a soft feel. Each bristle has a base diameter B and a tip diameter T. The base diameter B is preferably about 0.067 of an inch, while the tip diameter T is preferably about 0.035 of an inch. These dimensions may vary by about plus or minus 0.003 of an inch. Thus, the base diameter may vary from about 0.064 of an inch to about 0.070 of an inch, while the tip diameter T may vary from about 0.032 of an inch to about 0.038 of an inch. These slender dimensions, with the use of a medium hard polyethylene material, produce soft comfortable bristles for use in personal grooming.

The modified retractrable brush of FIG. 15 is designated 190. It will be seen that the bristles 24 have smoothly rounded tips 192 for maximum comfort in use. The bristles 24 are extensible and retractable through the openings 34 in the front wall 32 of the casing 22. In this case, bristle cleaning flaps 72 are omitted.

The bristles 24 of FIG. 15 are preferably molded integrally with the bristle supporting plate or member 26. A smoothly rounded inside corner or chamfer 194 is preferably provided between the base of each bristle 24 and the bristle supporting member 26, to strengthen the bristles and to minimize the possibility that any bristle might be broken at its junction with the bristle supporting member 26.

Less slender bristle dimensions have been employed in the past. Thus, relatively hard, stiff bristles have been produced by using a base diameter B of about 0.105 of an inch, while using a tip diameter of about 0.047 of an inch.

The more slender bristles, molded from polyethylene having medium softness and density, produce bristles having a soft, comfortable feel and an efficient brushing action.

I claim:

1. A retractable dispensing brush, comprising a casing including front and rear members, said front member having a front wall with a plurality of openings therein, a bristle member movable within said casing and having a plurality of bristles thereon movable outwardly and retractable inwardly through said openings, said rear member being rotatable about a predetermined axis relative to said front member, means in said casing for causing said bristles to be extended and retracted in response to such relative rotation, an axial member extending between said rear and front members, said casing having an axial opening therein extending through said axial member and said front and rear members between the rear side of said rear member and the front side of said front wall, a dispensing squeeze container mounted opposite the rear side of said rear member for holding a material to be dispensed, and disengageable coupling means for mounting said dispensing container on said casing while connecting the interior of said dispensing squeeze container to said axial opening for dispensing the material through said axial opening to the front side of said front wall for use in conjunction with said bristles, said dispensing squeeze container including collapsible wall means for imparting pressure to the material to be dispensed, said disengageable coupling means comprising means for removably securing said dispensing squeeze container to said rear member of said casing, and telescopically engageable elements on said rear member and said axial member for transferring the material from said dispensing squeeze container to said axial member.

2. A retractable dispensing brush, comprising a casing including front and rear members, said front member having a front wall with a plurality of openings therein, a bristle member movable within said casing and having a plurality of bristles thereon movable outwardly and retractable inwardly through said openings, said rear member being rotatable about a predetermined axis relative to said front member, means in said casing for causing said bristles to be extended and retracted in response to such relative rotation, an axial member extending between said rear and front members, said casing having an axial opening therein extending through said axial member and said front and rear members between the rear side of said rear member and the front side of said front wall, a dispensing squeeze container mounted opposite the rear side of said rear member for holding a material to be dispensed, and disengageable coupling means for mounting said dispensing container on said casing while connecting the interior of said dispensing squeeze container to said axial opening for dispensing the material through said axial opening to the front side of said front wall for use in conjunction with said bristles, said dispensing squeeze container including collapsible wall means for imparting pressure to the material to be dispensed, said disengageable coupling means comprising screw thread elements on said dispensing squeeze container and said rear member of said casing for removably securing said container to said rear member, and a tubular element on said rear member and engaged with the rear portion of said axial member for transferring the material to be dispensed from said dispensing squeeze container to said axial member.

3. A retractable dispensing brush, comprising a casing including front and rear members, said front member having a front wall with a plurality of openings therein, a bristle member movable within said casing and having a plurality of bristles thereon movable outwardly and retractable inwardly through said openings, said rear member being rotatable about a predetermined axis relative to said front member, means in said casing for causing said bristles to be extended and retracted in response to such relative rotation, an axial member extending between said rear and front members, said casing having an axial opening therein extending through said axial member and said front and rear members between the rear side of said rear member and the front side of said front wall, a dispensing squeeze container mounted opposite the rear side of said rear member for holding a material to be dispensed, and disengageable coupling means for mounting said dispensing container on said casing while connecting the interior of said dispensing squeeze container to said axial opening for dispensing the material through said axial opening to the front side of said front wall for use in conjunction with said bristles, said dispensing squeeze container including collapsible wall means for imparting pressure to the material to be dispensed, said disengageable coupling means comprising telescopically engageable coupling elements on said dispensing squueze container and said rear member, detent means for removably retaining said telescopically engageable elements in engagement, and additional telescopically engageable tubular members on said rear member and said axial member for transferring the material from said dispensing squeeze container to said axial member.

4. A retractable dispensing brush, comprising a casing including front and rear members, said front member having a front wall with a plurality of openings therein, a bristle member movable within said casing and having a plurality of bristles thereon movable outwardly and retractable inwardly through said openings, said rear member being rotatable about a predetermined axis relative to said front member, means in said casing for causing said bristles to be extended and retracted in response to such relative rotation, an axial member extending between said rear and front members, said casing having an axial opening therein extending through said axial member and said front and rear members between the rear side of said rear member and the front side of said front wall, a dispensing squeeze container mounted opposite the rear side of said rear member for holding a material to be dispensed, and disengageable coupling means for mounting said dispensing container on said casing while connecting the interior of said dispensing squeeze container to said axial opening for dispensing the material through said axial opening to the front side of said front wall for use in conjunction with said bristles, said dispensing squeeze container including collapsible wall means for imparting pressure to the material to be dispensed, said disengageable coupling means including a tubular coupling element on said dispensing squeeze container and disengageably receivable within a portion of said axial member, and detent means for removably retaining said tubular element within said axial member.

5. A brush according to claim 4, in which said dispensing squeeze container takes the form of a squeeze bottle.

6. A retractable dispensing brush, comprising a casing including front and rear members, said front member having a front wall with a plurality of openings therein, a bristle member movable within said casing and having a plurality of bristles thereon movable outwardly and retractable inwardly through said openings, said rear member being rotatable about a predetermined axis relative to said front member, means in said casing for causing said bristles to be extended and retracted in response to such relative rotation, an axial member extending between said rear and front members, said casing having an axial opening therein extending through said axial member and said front and rear members between the rear side of said rear member and the front side of said front wall, a dispensing squeeze container mounted opposite the rear side of said rear member for holding a material to be dispensed, and disengageable coupling means for mounting said dispensing container on said casing while connecting the interior of said dispensing squeeze container to said axial opening for dispensing the material through said axial opening to the front side of said front wall for use in conjunction with said bristles, said dispensing squeeze container including collapsible wall means for imparting pressure to the material to be dispensed, said disengageable coupling means comprising telescopically engageable elements on said container and said axial member, and detent means for removably retaining said telescopically engageable elements in their engaged position.

7. A brush according to claim 6, in which said dispensing squeeze container takes the form of a squeeze bottle.

* * * * *